US011728594B2

(12) United States Patent
Kobayashi

(10) Patent No.: US 11,728,594 B2
(45) Date of Patent: Aug. 15, 2023

(54) ELECTRICAL CONNECTOR WITH SHIELDING BETWEEN CONTACTS

(71) Applicant: HOSIDEN CORPORATION, Osaka (JP)

(72) Inventor: Hideto Kobayashi, Gunma (JP)

(73) Assignee: HOSIDEN CORPORATION, Osaka (JP)

( * ) Notice: Subject to any disclaimer, the term of this patent is extended or adjusted under 35 U.S.C. 154(b) by 0 days.

(21) Appl. No.: 17/381,682

(22) Filed: Jul. 21, 2021

(65) Prior Publication Data

US 2022/0102918 A1 Mar. 31, 2022

(30) Foreign Application Priority Data

Sep. 30, 2020 (JP) ..... 2020-165566

(51) Int. Cl.

| | |
|---|---|
| ***H01R 13/6591*** | (2011.01) |
| ***H01R 13/504*** | (2006.01) |
| ***H01R 13/6581*** | (2011.01) |
| ***H01R 13/6471*** | (2011.01) |
| ***H01R 13/6585*** | (2011.01) |
| ***H01R 13/6586*** | (2011.01) |
| *H01R 24/20* | (2011.01) |
| *H01R 13/646* | (2011.01) |

(52) U.S. Cl.

CPC ... *H01R 13/65914* (2020.08); *H01R 13/5045* (2013.01); *H01R 13/6471* (2013.01); *H01R 13/6581* (2013.01); *H01R 13/6585* (2013.01); *H01R 13/6586* (2013.01); *H01R 13/646* (2013.01); *H01R 24/20* (2013.01)

(58) Field of Classification Search

CPC ..... H01R 13/65914; H01R 13/5045; H01R 13/6471; H01R 13/6581; H01R 13/6585; H01R 13/6586; H01R 13/646; H01R 24/20

See application file for complete search history.

(56) References Cited

U.S. PATENT DOCUMENTS

2013/0244482 A1 9/2013 Kondo
2017/0331235 A1* 11/2017 Yokoyama ..... H01R 12/724

FOREIGN PATENT DOCUMENTS

| | | | | |
|---|---|---|---|---|
| CN | 107093822 A | * | 8/2017 | |
| CN | 108493654 B | * | 10/2019 | ..... H01R 13/02 |
| DE | 9820857 T2 | * | 12/2004 | |
| DE | 69820857 T2 | * | 12/2004 | |
| JP | 2013-225475 | | 10/2013 | |

* cited by examiner

*Primary Examiner* — Abdullah A Riyami
*Assistant Examiner* — Justin M Kratt
(74) *Attorney, Agent, or Firm* — Greenblum & Bernstein, P.L.C.

(57) ABSTRACT

A connector includes: a contact batch that is composed of two or more groups of contacts; an inner shield that electrically separates the two or more groups of contacts from each other; a body in which the contact batch and the inner shield are press-fitted and fixed; and a shell that covers the contact batch, the inner shield, and the body.

2 Claims, 5 Drawing Sheets

ELECTRICAL CONNECTOR WITH SHIELDING BETWEEN CONTACTS

TECHNICAL FIELD

The present invention relates to a connector.

BACKGROUND ART

Japanese Patent Application Laid Open No. 2013-225475 (hereinafter, referred to as Patent Literature 1), for example, discloses a connector of related art.

Differential impedance in a connector is controlled based on a balance between an inter-contact distance and a distance of surrounding dielectric material to ground (GND).

In related art, shield GND around contacts has been provided only on one side of a signal line positioned on an end side and therefore, differential impedance has been often imbalanced.

In the connector of Patent Literature 1, a GND contact having the same size as a signal line is disposed next to the signal line so as to balance differential impedance.

The configuration of the connector in Patent Literature 1 has a problem of increase in the number of pins and resulting increase in connector size.

SUMMARY OF THE INVENTION

An object of the present invention is to provide a connector that realizes improvement in differential impedance balance without increasing the number of pins.

A connector according to the present invention includes: a contact batch that is composed of two or more groups of contacts; an inner shield that electrically separates the two or more groups of contacts from each other; a body in which the contact batch and the inner shield are press-fitted and fixed; and a shell that covers the contact batch, the inner shield, and the body.

Effects of the Invention

According to the connector of the present invention, differential impedance balance can be improved without increasing the number of pins.

DETAILED DESCRIPTION

Figure 1:
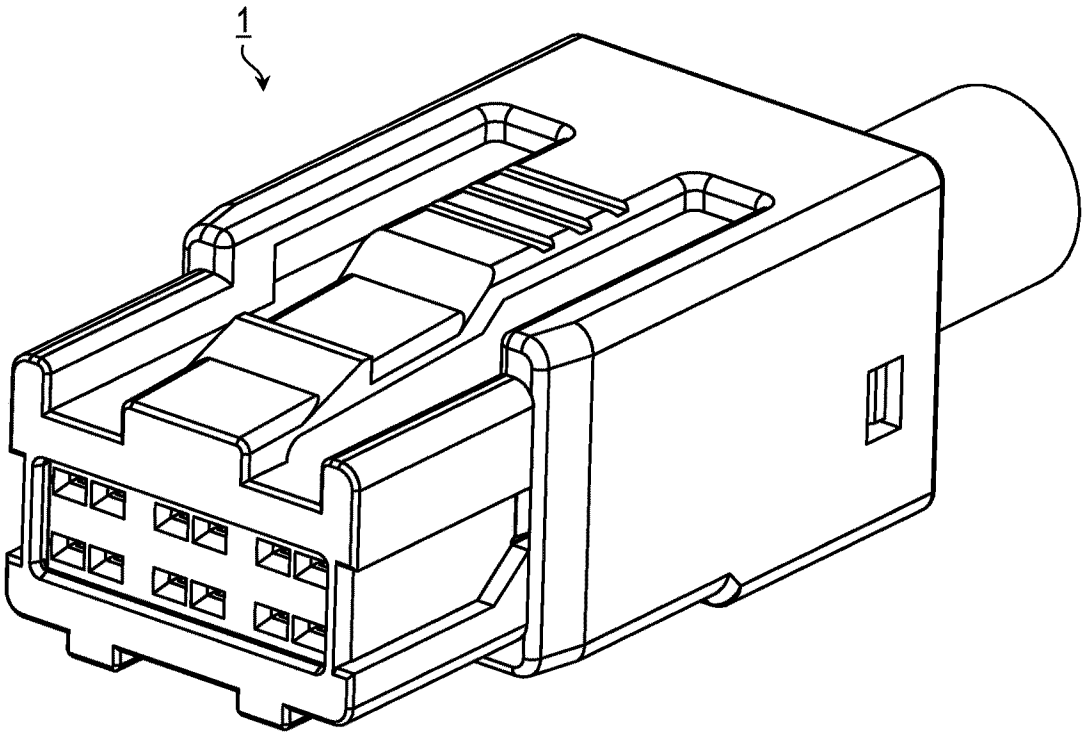
FIG. 1 is a perspective view illustrating a connector according to a first embodiment.

An embodiment of the present invention will be described in detail below. Components mutually having the same functions will be provided with the same reference numerals and duplicate description thereof will be omitted.

First Embodiment

Figure 2:
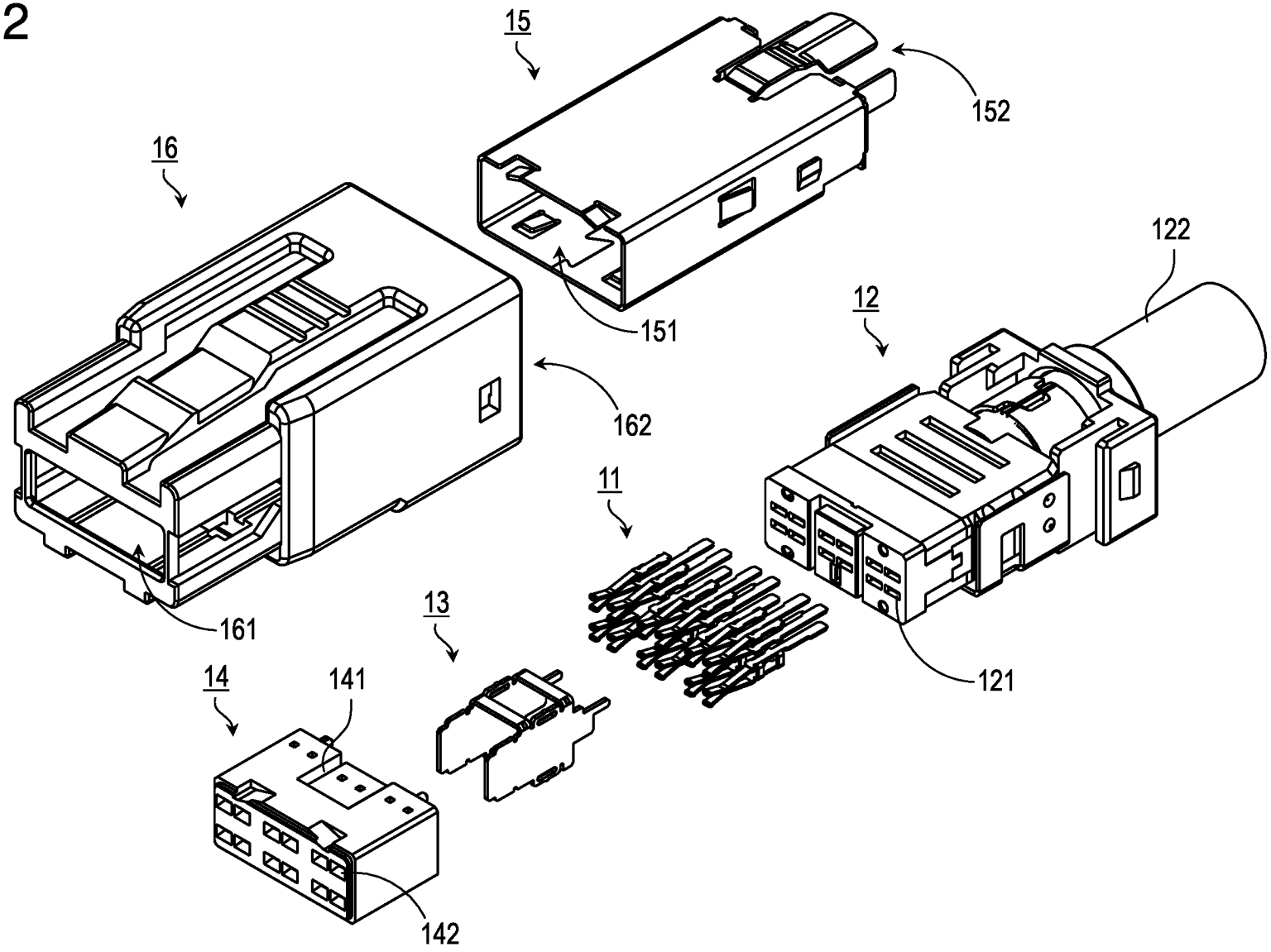
FIG. 2 is an exploded perspective view illustrating the connector according to the first embodiment.

FIG. 1 is a perspective view of a connector 1 according to a first embodiment, and FIG. 2 is an exploded perspective view of the connector 1 according to the first embodiment. The connector 1 according to the present embodiment includes a contact batch 11, an assembly 12, an inner shield 13, a body 14, a shell 15, and a case 16, as illustrated in FIG. 2. The contact batch 11 is composed of two or more groups of contacts. The assembly 12 includes contact insertion slots 121 into which respective contacts of the contact batch 11 are inserted, core wires which are respectively connected to the contacts, and a cable 122 through which the core wires are inserted. The inner shield 13 electrically separates the groups of contacts from each other. The contact batch 11 and the inner shield 13 are press-fitted and fixed in the body 14. The shell 15 covers the contact batch 11, the assembly 12, the inner shield 13, and the body 14. The case 16 covers the shell 15.

The body 14 has a substantially rectangular parallelepiped shape and is made of resin, for example. On the back surface of the body 14 (a surface facing the connector pulling-out direction), slits 141 in which the inner shield 13 is press-fitted are provided. Here, the slit 141 does not penetrate toward the front surface side of the body 14 and the inner shield 13 is not exposed on the front surface side of the body 14. Contact through holes 142 that penetrate from the front surface to the back surface of the body 14 are further provided. The contacts of the contact batch 11 are press-fitted in the contact through holes 142 respectively.

The shell 15 is a metal case having a substantially rectangular parallelepiped shape. The front surface and back surface of the shell 15 (surfaces respectively positioned to face the connecting direction and pulling-out direction of the connector 1) are opened to form opening portions 151 and 152 respectively. The front surface of the body 14 is exposed from the opening portion 151.

As is the case with the shell 15, the front surface and back surface of the case 16 (surfaces respectively positioned to face the connecting direction and pulling-out direction of the connector 1) are opened to form opening portions 161 and 162 respectively. The front surface of the body 14 is exposed from the opening portion 161. The case 16 is made of an insulator material (for example, resin).

Figure 3:
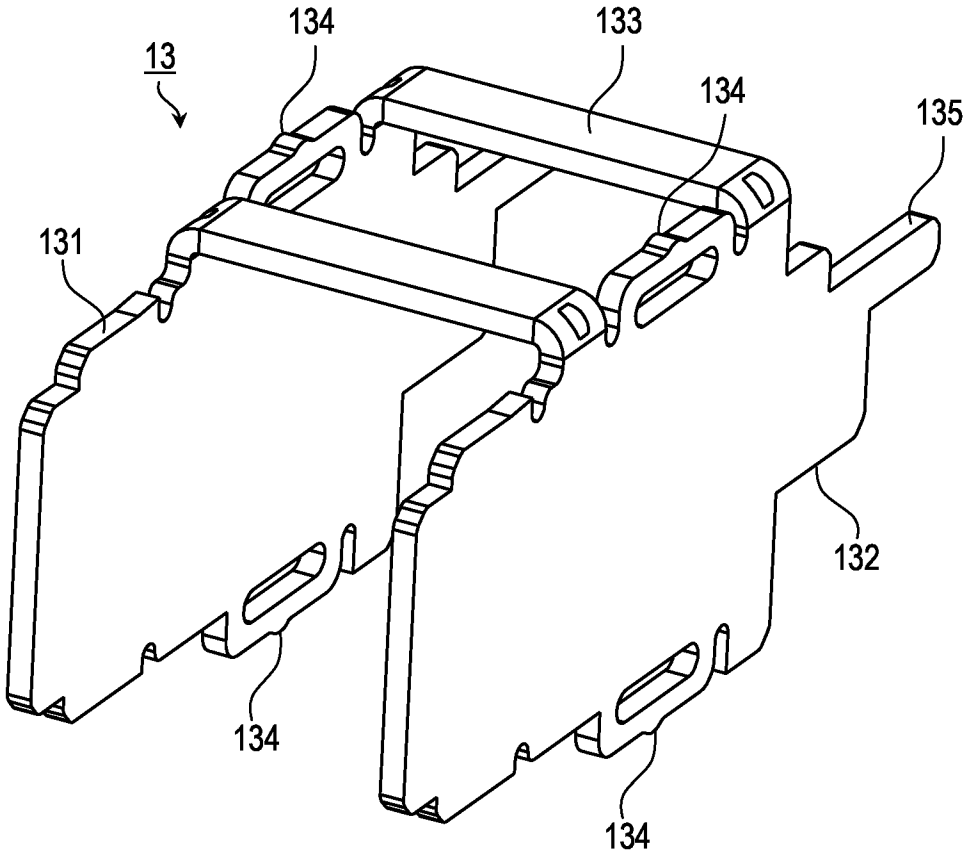
FIG. 3 is a perspective view illustrating an inner shield of the connector according to the first embodiment.

The shape of the inner shield 13 will be described with reference to FIGS. 3, 4, and 5. The inner shield 13 has a shape including shielding boards 131 and 132, a bridge portion 133, convex portions 134, and terminals 135. The shielding boards 131 and 132 are disposed to separate the groups of contacts from each other (refer to FIG. 4). The bridge portion 133 connects the shielding boards to each other, and the convex portions 134 are respectively provided on the upper end surfaces and lower end surfaces of the shielding boards 131 and 132 and are brought into contact with inner surfaces of the shell 15 (refer to FIG. 5). The terminals 135 are formed by respectively extending part of end surfaces of the shielding boards 131 and 132 on the back surface side thereof (facing the pulling-out direction of the connector 1) toward the back surface side of the connector 1 (in the pulling-out direction of the connector 1) and are to be connected with GND lines.

Figure 4:
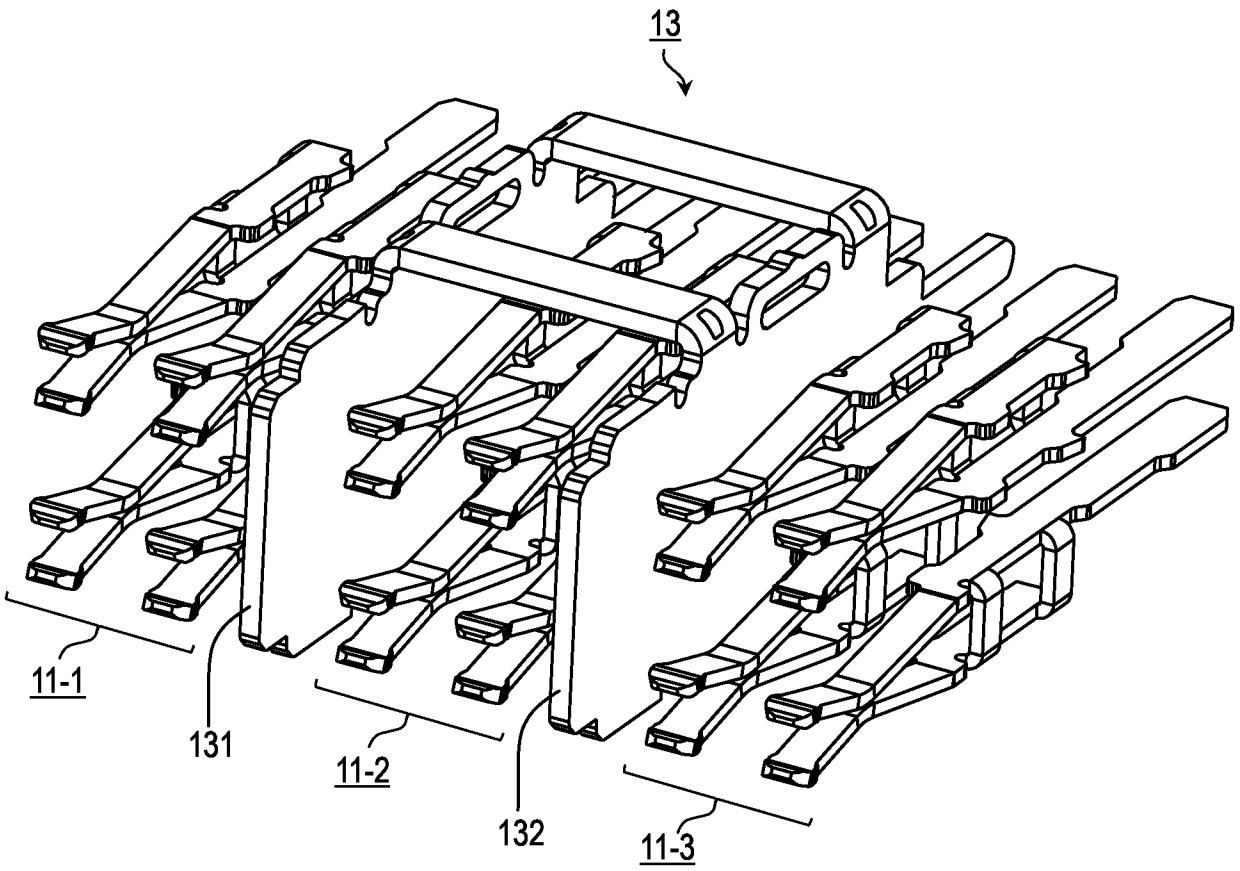
FIG. 4 is a perspective view illustrating a positional relation between the inner shield and a contact batch of the connector according to the first embodiment.

As illustrated in FIG. 4, when it is defined that the contact batch 11 is composed of a first contact group 11-1, a second contact group 11-2, and a third contact group 11-3, the shielding board 131 is disposed to separate (shield) the first contact group 11-1 from the second contact group 11-2. The shielding board 132 is disposed to separate (shield) the second contact group 11-2 from the third contact group 11-3.

Figure 5:
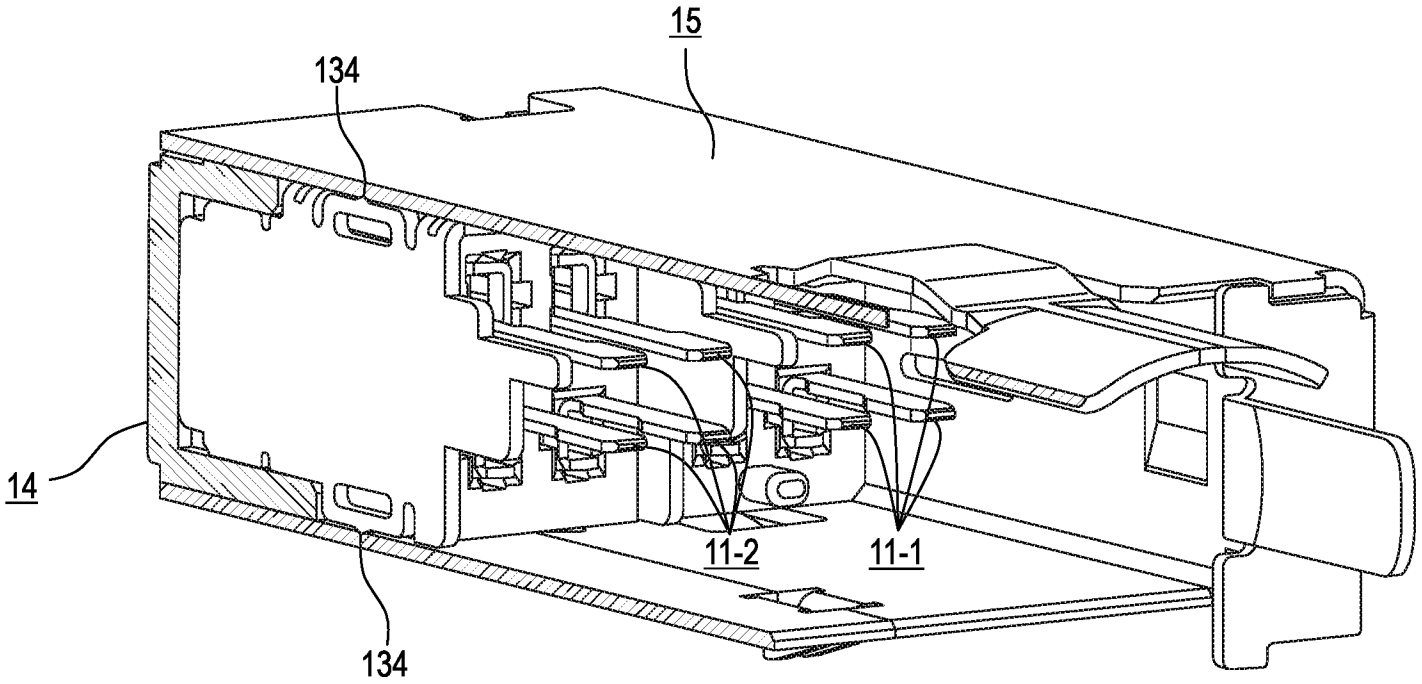
FIG. 5 is a perspective sectional view illustrating a state that only the contact batch, the inner shield, a body, and a shell among components of the connector according to the first embodiment are assembled and cut at a predetermined position.

As illustrated in FIG. 5, the slit 141 penetrates through the upper surface side and bottom surface side of the body 14 and the convex portions 134 are exposed from the body 14 to directly come into contact with the inner surfaces of the shell 15.

As disclosed in the first embodiment, the inner shield 13 (the shielding boards 131 and 132) is disposed in the inside of the connector 1 so as to separate (electrically shield) the groups of contacts from each other, and the inner shield 13 includes the convex portions 134 that are to be connected with the shell 15 and the terminals 135 that are to be connected with the GND lines, providing the following advantageous effects.

(1) GND is positioned at an equal distance around all differential signal contacts, so differential impedance is stably balanced and improvement in transmission characteristic quality can be accordingly expected.

(2) A GND contact does not have to be disposed next to a signal line, so differential impedance can be stably balanced without increasing the number of pins and the connector size.

(3) The inner shield 13 shields the contacts from each other, so noise influence that is mutually given by different differential signals is suppressed and crosstalk can be accordingly reduced.

The foregoing description of the embodiment of the invention has been presented for the purpose of illustration and description. It is not intended to be exhaustive and to limit the invention to the precise form disclosed. Modifications or variations are possible in light of the above teaching. The embodiment was chosen and described to provide the best illustration of the principles of the invention and its practical application, and to enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A connector comprising:

a contact batch that is composed of two or more groups of contacts;

an inner shield that electrically separates the two or more groups of contacts from each other, wherein the inner shield includes:

a convex portion that is brought into contact with an inner surface of the shell, shielding boards that are disposed to separate the two or more groups of contacts from each other, and a bridge portion that connects the shielding boards to each other;

a body in which the contact batch and the inner shield are press-fitted and fixed; and a shell that covers the contact batch, the inner shield, and the body, wherein the convex portion is provided on an upper end surface and a lower end surface of each of the shielding boards.

2. A connector comprising:

a contact batch that is composed of two or more groups of contacts;

an inner shield that electrically separates the two or more groups of contacts from each other, wherein the inner shield includes:

a terminal that is extended in a pulling-out direction of the connector and is connected with a ground (GND) line, shielding boards that are disposed to separate the two or more groups of contacts from each other, and a bridge portion that connects the shielding boards to each other;

a body in which the contact batch and the inner shield are press-fitted and fixed; and a shell that covers the contact batch, the inner shield, and the body, wherein the terminal is formed by extending part of an end surface, the end surface facing the pulling-out direction of the connector, of each of the shielding boards toward the pulling-out direction of the connector.

* * * * *